United States Patent [19]

Lucke

[11] 4,055,312

[45] Oct. 25, 1977

[54] PROCESS AND EQUIPMENT FOR THE MANUFACTURE OF YARN OR THREAD ON A REEL MACHINE

[75] Inventor: Florian Lucke, Stuttgart, Germany

[73] Assignee: Croon & Lucke Maschinenfabrik GmbH & Co. KG, Germany

[21] Appl. No.: 634,617

[22] Filed: Nov. 24, 1975

[30] Foreign Application Priority Data

Dec. 21, 1974 Germany ..... 2460845

[51] Int. Cl.[2] ..... B65H 54/28

[52] U.S. Cl. ..... 242/43.1; 242/43 R; 242/174

[58] Field of Search ..... 242/43 R, 43.1, 174, 242/177, 178

[56] References Cited

U.S. PATENT DOCUMENTS

| | | | |
|---|---|---|---|
| 408,841 | 8/1889 | Mitchell | 242/174 X |
| 1,968,406 | 7/1934 | Lambeck | 242/43.1 |
| 2,296,420 | 9/1942 | Campbell | 242/177 |
| 2,858,993 | 11/1958 | Siegenthaler | 242/43.1 |

FOREIGN PATENT DOCUMENTS

| | | | |
|---|---|---|---|
| 168,668 | 3/1905 | Germany | 242/174 |
| 502,849 | 3/1939 | United Kingdom | 242/178 |

*Primary Examiner*—John Petrakes
*Attorney, Agent, or Firm*—Hauke & Patalidis

[57] ABSTRACT

A process and apparatus for winding a yarn or thread on a reel or bobbin by way of a reciprocating yarn or thread guiding device, and which comprises a pair of settable counters driven by the bobbin or reel basket drive. After a predetermined number of revolutions of the bobbin or reel basket has been counted by one of the counters, the reciprocating guiding device is operated so as to decrease the width of the yarn or thread layers wound on the reel or bobbin and at the same time start the second counter which, after a predetermined number of revolutions, shuts off the reel basket drive.

5 Claims, 1 Drawing Figure

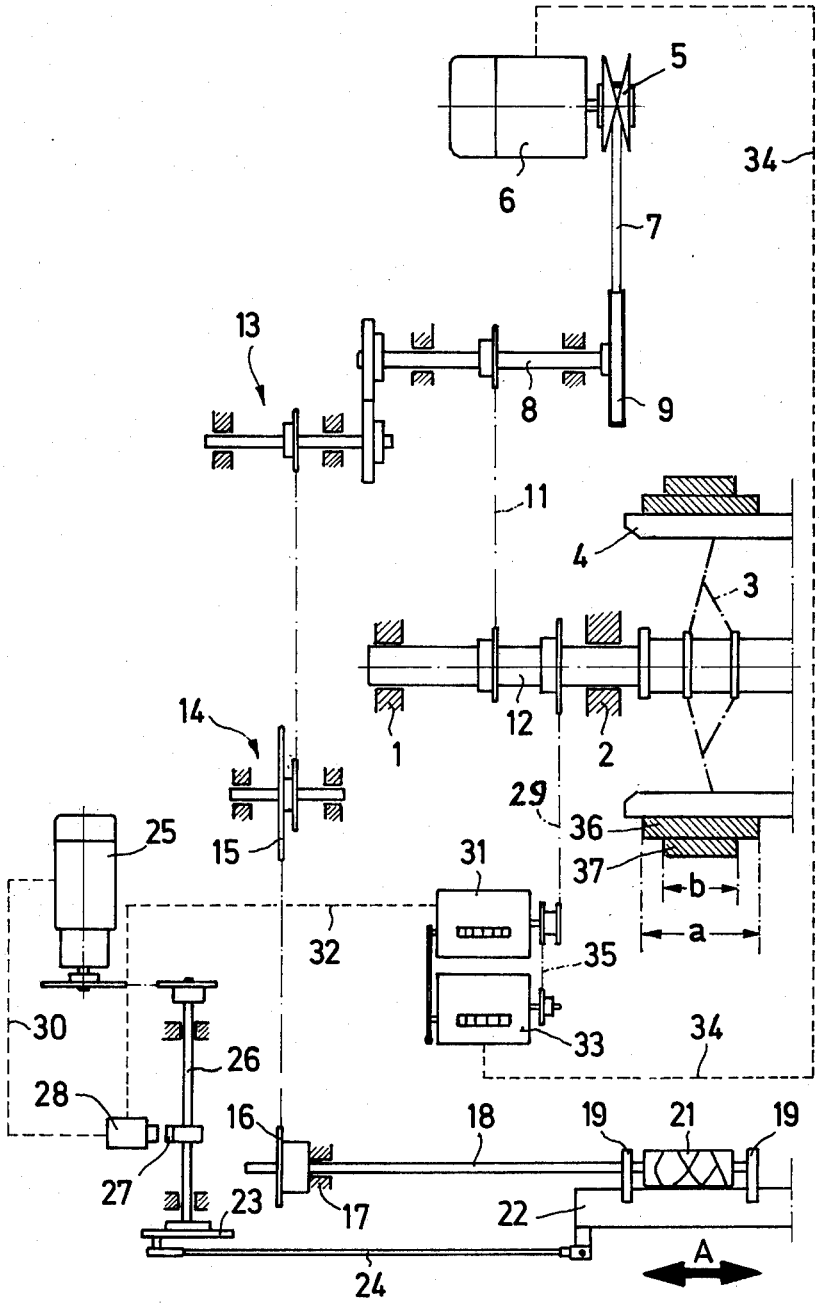
5
6
7
34
13
8
9
11
4
3
12
1
2
14
29
36
37
25
15
31
b
a
32
35
30
33
34
26
28
16
18
19
21
19
27
23
17
22
A
24

PROCESS AND EQUIPMENT FOR THE MANUFACTURE OF YARN OR THREAD ON A REEL MACHINE

BACKGROUND OF THE INVENTION

The present invention relates to a process and apparatus for winding yarn or thread as a skein on a bobbin or reel. More particularly, the present invention relates to a process and means for winding a skein of yarn or thread on a reel or bobbin, for example at the end of a yarn or thread spinning operation, such that, in the course of additional handling of the skein, the upper layers of thread or yarn are prevented from getting under the lower layers. In addition, the present invention relates to a device for use with a rotary driven bobbin or reel basket provided with a reciprocating yarn or thread laying and guiding device.

Known processes and apparatus for spooling of yarn or thread, in the course of manufacture of such yarn or thread, provide skeins having a substantially rectangular or trapezoidal shaped cross section. The inconvenience of such a shape of yarn or thread skein wound on a bobbin or reel is that the top layers of yarn or thread may slid down sideways along the outer edge of the skein and get entangled with the lower layers of thread. This "falling over" of the edges of the yarn or thread occurs especially during further processing of the yarn or thread when the skein is removed from the reeling machine, for example when cotton yarn is mercerized. If the top layers of yarn or thread of a skein fall over on the lower layers, respooling of the skein upon completion of a finishing step in a manufacturing process becomes a serious problem.

The present invention eliminates such inconveniences and shortcomings of the prior art by providing a process and apparatus which prevents the top layers of thread or yarn from being pulled under the lower layers in the course of a spooling operation. The present invention accomplishes its object by winding the lower layers of the skein across a certain layer width on the reel or bobbin and by winding the upper layers across a lesser width, such that a stepped cross section of the skein results.

SUMMARY OF THE INVENTION

The present invention accomplishes its object by controlling a spooling apparatus or reel basket and a reciprocating yarn or thread laying and guiding element connected therewith by way of a pair of settable counters connected to the reel basket drive and set for a predetermined number of revolutions of the reel basket. One counter is effective, after a predetermined number of layers have been wound on the reel or bobbin, to cause a decrease of the width of the layer, for example towards the middle of a spooling operation, while, at the same time, starting a second counter which in turn upon completion of a certain additional number of revolutions shuts off the reel basket drive motor.

The present invention will become apparent to those skilled in the art when the following description of a preferred embodiment for practicing the invention is read in conjunction with the accompanying drawing which illustrates, in a schematic manner, such preferred embodiment of the present invention.

DETAILED DESCRIPTION OF THE PREFERRED EMBODIMENT

As shown in the drawing, a pair of bearings 1 and 2 support, journaled therein, a shaft 12 on which is mounted a conventional spooling reel basket 4, expandable and collapsible by means of a lever system, well known in the art, schematically shown by dot and dash line 3. The drive shaft 12 of the reel basket 4 is driven by an electric motor 6 provided with a variable diameter drive pulley 5 driving through a belt 7 a pulley 9 mounted on the end of a countershaft 8, the countershaft 8 in turn driving by any convenient means such as a chain, a gear train or a pulley and belt drive system, schematically represented at 11, the reel basket drive shaft 12. The countershaft 8 further drives an intermediate drive shaft 13 in turn driving a control drive shaft 14. The control drive shaft 14 is provided with a pulley 15 in turn driving a pulley 16 mounted on the end of a shaft 18 journaled in bearings 17. The pulley 16 is connected to the shaft 18 by a sliding driving arrangement, such as a spline coupling for example, such that the shaft 18 is capable of axial motion relative to the pulley 16. The shaft 18 in turn drives, supported between bearings 19—19 a conventional thread laying grooved roller 21. The bearings 19 are affixed to a slide 22 which is reciprocable back and forth as indicated by the arrow A. The grooved roller 21 and its reciprocating support slide 22 form part of a yarn and thread laying and guiding device which feeds yarn or thread onto the periphery of the reel basket 4 while the reel basket is rotating such that consecutive superimposed layers of yarn or thread are wound about the periphery of the reel basket. The support slide 22 is supported by a linear bearing, not shown, and is reciprocated by means of a connecting rod 24 having an end excentrically connected to a disc 23. The disc 23 is mounted on the end of a shaft 26 driven by an electric motor 25. A permanent magnet 27 is mounted on the shaft 26 and rotated in unison therewith, and the permanent magnet 27 is adapted to activate by proximity a magnetic relay 28 for shutting off the motor 25. The magnetic relay 28 is normally off, and it must first be turned on by a pulse, so as to shut off the motor 25, via a circuit 30 when, the permanent magnet 27 next passes in proximity to the relay 28.

A counter 31 which can be preset to a predetermined numerical value is connected to the drive shaft 12 of the reel basket 4 by means of a gear drive and/or electric means schematically indicated by line 29. The counter 31, upon reaching for example a zero count, that is after completion of a predetermined number of revolutions of the reel basket 4, activates the magnetic relay 28 by means of a pulse via a line 32, schematically represented by a dash line, thus causing the magnetic relay 28 to in turn shut off the motor 25 when the permanent magnet 27 is brought by rotation of the shaft 26 directly opposite the switch 28. The permanent magnet 27 is mounted on the shaft 26 preferably at such a position that the support slide 22 is stopped at its central position when the rotation of the shaft 26 is stopped by way of the permanent magnet 27 actuating the magnetic relay 28, the central stopping position of the support slide 22 corresponding with the median line of a layer of thread or yarn being wound about the reel basket 4. The counter 31 is coupled with another presetable counter 33 which switches off the drive motor 6 of the reel basket 4 via a control line 34 shown as a dash line. The counter 33 is activated simultaneously with the activation of the magnetic relay 28, i.e., during the idle run of the counter 31, this action being schematically illustrated by a line 35 in the drawing.

The operation of the apparatus schematically illustrated in the drawing is as follows:

After the motors 6 and 25 have been turned on, for example by means of a main control switch, not shown, the grooves of the grooved roller 21 feed the thread or yarn being spooled onto the rotating reel basket 4. The thread or yarn therefore is displaced back and forth, transversely, by way of the grooved roller 21. Superimposed on this back and forth motion is the motion of the support slide 22, such that the yarn or thread is layered onto the reel basket 4 with a layer having a width *a*. In this manner, several lower layers 36 of thread or yarn are spooled onto the reel basket 4. The counter 31 has been previously set to a certain number of revolutions corresponding to a predetermined number of layers of thread or yarn. As soon as the counter 31 reaches zero, it shuts off the reciprocating motion of the support slide 22 coming to rest exactly at or proximate to the middle of the outer layer of the pile of layers 36. At the same time, the counter 31 starts the counter 33 which has been previously also set to a certain number of revolutions of the reel basket corresponding with a predetermined number of layers of thread or yarn. The grooved roller 21, its support slide 22 being now standing still, keeps on rotating and guides in its groove the thread or yarn being spooled to a width corresponding to the width of the grooved portion of the roller, such that successive layers 37 of thread or yarn, having a width *b*, are layed on the top of the superimposed layers 36 precedently spooled upon the reel basket. As soon as the counter 33 counts down to zero, it shuts off the reel basket drive motor 6 via the line 34. Therefore, the skein spooled about the reel basket 4 consists of a stepped arrangement comprising the group of lower layers 36 of thread or yarn and the group of upper layers 37, with the result that the thread or yarn which may slide sideways off the edge of the upper layers 37 cannot become entangled under the lower layers because they are caught on the top of the layers 36.

The height of both thread or yarn layers 36 and 37 in relation to each other is determined by the properties of the thread or yarn such as its roughness, etc. For example, both layers may be of equal height, but the thread or yarn may be spooled such that the group of layers 36 has a larger number of superimposed layers than the group 37, or vice versa.

Although two counters 31 and 33 have been illustrated in the drawing, the two counters may be replaced by a single counter which provides a switching pulse upon reaching a predetermined intermediate numerical value as well as upon reaching a zero value. Upon reaching the intermediate value, the drive of the support slide 22 is switched off, and upon reaching the zero value, the drive of the reel basket 4 is shut off.

Having thus described the present invention by way of a practical embodiment thereof, modifications whereof will be apparent to those skilled in the art, what is claimed as new is as follows:

1. In a yarn or thread spooling apparatus comprising a rotary driven reel basket and yarn or thread laying means for guiding said yarn or thread along superimposed layers of predetermined width wound about said reel basket, the improvement comprising reciprocating support means for said yarn or thread laying means for spooling said yarn or thread along superimposed layers of a larger width than said predetermined width, means for counting a first number of revolutions of said reel basket, means operated by said counting means for shutting off said reciprocating support means after said first number of revolutions, and means for shutting off said rotary driven reel basket upon completion of a predetermined second number of revolutions.

2. The apparatus of claim 1 further comprising means for shutting off the reciprocation of said support means substantially at the center of a layer of said larger width.

3. The apparatus of claim 1 wherein said yarn or thread laying means is a grooved roller and said support means is a slide rotatably supporting said grooved roller.

4. The apparatus of claim 3 wherein said means for counting said first number of revolutions is a single counter preset for shutting off the reciprocation of said slide upon reaching said first number of revolutions and for shutting off said rotary driven reel basket upon reaching said predetermined second number of revolutions.

5. The apparatus of claim 3 wherein said counting means is a pair of counters, the first of which is arranged to provide a control pulse upon reaching said first number of revolutions and for simultaneously starting a second counter adapted to shut off said rotary driven reel basket upon reaching said predetermined second number of revolutions.

* * * * *